US005897030A

United States Patent [19]

Stangle

[11] Patent Number: 5,897,030

[45] Date of Patent: Apr. 27, 1999

[54] TOOTHPASTE DISPENSER

[76] Inventor: John A. Stangle, 111A E. North St., Waukesha, Wis. 53188

[21] Appl. No.: 09/055,724

[22] Filed: Apr. 7, 1998

Related U.S. Application Data

[60] Provisional application No. 60/043,456, Apr. 10, 1997.

[51] Int. Cl.[6] ..... B65D 35/28

[52] U.S. Cl. ..... 222/103; 222/557

[58] Field of Search ..... 222/103, 105, 222/557

[56] References Cited

U.S. PATENT DOCUMENTS

| | | | |
|---|---|---|---|
| 2,597,273 | 5/1952 | Scott | 222/103 |
| 2,763,401 | 9/1956 | Buras, Jr. | 222/103 |
| 4,172,536 | 10/1979 | Holt | 222/103 |
| 4,213,543 | 7/1980 | Thiem | 222/103 |
| 5,105,984 | 4/1992 | Kazimir | 222/103 |
| 5,322,194 | 6/1994 | Roberts | 222/103 |

*Primary Examiner*—Philippe Derakshani
*Attorney, Agent, or Firm*—Donald J. Ersler

[57] ABSTRACT

A toothpaste dispenser includes, a base, a first wall, a second wall, a squeeze flap, a tube retainer, and a dispenser nozzle. The first and second walls are mounted to the base such that a toothpaste tube may be easily inserted therebetween. A second end of the squeeze flap is pivotally mounted to second ends of the first and second walls. A tube retainer is mounted to the base at a first end thereof. The tube retainer retains the tooth paste tube when pressure is exerted thereupon. There are two preferred embodiments of dispenser nozzles. The first preferred embodiment is a side dispensing nozzle. The second preferred embodiment is a swing nozzle.

16 Claims, 3 Drawing Sheets

TOOTHPASTE DISPENSER

BACKGROUND OF THE INVENTION

1. Cross-References to Related Applications

This is a provisional application, Ser. No. 60/043,456 filed on Apr. 10, 1997.

2. Field of the Invention

The present invention relates generally to collapsible tube dispensers and more specifically to a toothpaste dispenser which does not damage the toothpaste tube during squeezing and fully covers the toothpaste tube.

3. Discussion of the Prior Art

There are drawbacks to most prior art collapsible tube dispensers. Some prior art collapsible tube dispensers extract only 75 to 80 percent of the contents in the tube, because the construction of the tube dispenser does not allow the front of the tube to be effectively compressed. Some of these prior art tube dispensers will damage the collar at the front of the tube with the result of the tube leaking tooth paste and causing a mess.

Another drawback is one of cosmetics, some tube dispensers do not fully cover the toothpaste tube. Yet another drawback is the lack of convenient dispenser nozzles which are offered with some tube dispensers. Some prior art tube dispensers make the user rely upon the screw cap which comes with the tube of toothpaste.

Accordingly, there is a clearly felt need in the art for a toothpaste dispenser which allows a user to get more than 75 to 80 percent of the toothpaste out of the tube, fully covers the toothpaste tube, and provides an easy dispenser nozzle.

SUMMARY OF THE INVENTION

The primary objective of the present invention is to provide a toothpaste dispenser which allows a user to get more than 75 to 80 percent of the toothpaste out of the tube, fully covers the toothpaste tube, and provides an easy dispenser nozzle.

According to the present invention, a toothpaste dispenser includes a base, a first wall, a second wall, a squeeze flap, a tube retainer, and a dispenser nozzle. The base includes a base plate and a squeeze plate which is fastened to the base plate. The first wall and second wall are mounted to the base plate such that there is sufficient clearance for a toothpaste tube. A second end of the squeeze flap is pivotally mounted to second ends of the first and second walls. A tube retainer is mounted to the base plate at a first end thereof. The tube retainer retains the tooth paste tube when pressure is exerted on the tooth paste tube.

The dispenser nozzle has two preferred embodiments. The first preferred embodiment of the dispenser nozzle is a side dispensing nozzle. The side dispensing nozzle includes a small tube which extends outward and slightly upward toward the tube. When the tooth paste tube is squeezed, the tooth paste exits through the small tube on to the tooth brush of an user. The small tube is not sealed after usage.

The second preferred embodiment of the dispenser nozzle is a swing nozzle. The swing nozzle includes a body with a slot in the wall of the body and a swing lever. The swing lever is pivotally mounted to the body and slides into and out of the slot. The swing nozzle may be closed by rotating the swing lever into the slot of the body.

Accordingly, it is an object of the present invention to provide a toothpaste dispenser which increases the percentage of toothpaste extracted from a toothpaste tube.

It is a further object of the present invention to provide a toothpaste dispenser which does not damage the collar of the toothpaste tube.

It is yet a further object of the present invention to provide a toothpaste dispenser which fully covers the toothpaste tube.

Finally, it is another object of the present invention to provide a toothpaste dispenser which includes easy to use dispenser nozzles which may be threaded on to the toothpaste tube.

These and additional objects, advantages, features and benefits of the present invention will become apparent from the following specification

DETAILED DESCRIPTION OF THE PREFERRED EMBODIMENTS

Figure 1:
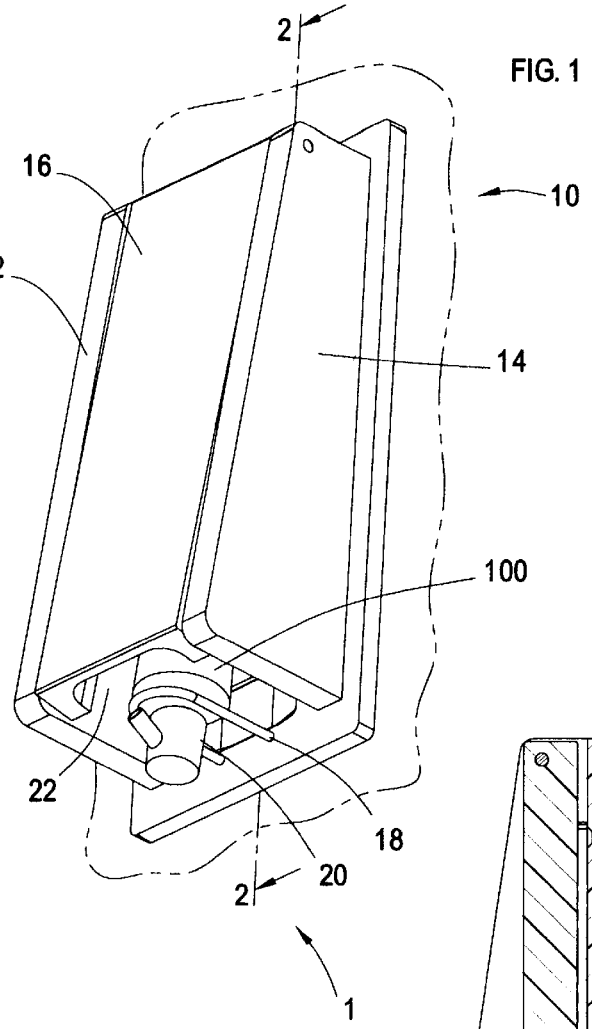
FIG. 1 is a perspective view of a toothpaste dispenser as would be mounted to a wall in accordance with the present invention.
Figure 2:
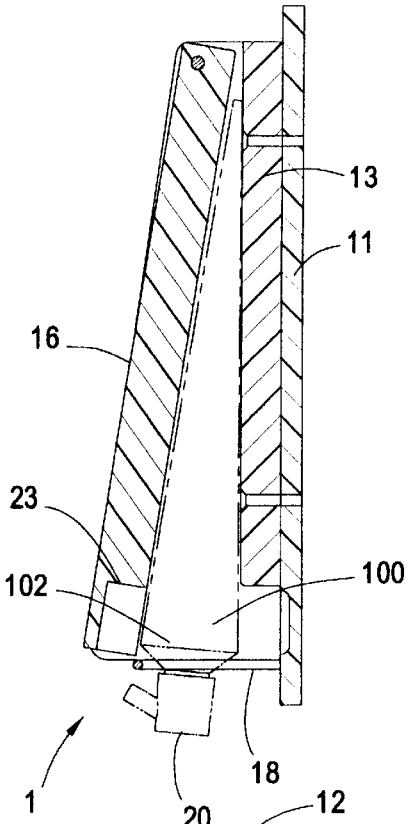
FIG. 2 is a cross sectional view of a full tube of tooth paste in the toothpaste dispenser in accordance with the present invention.
Figure 3:
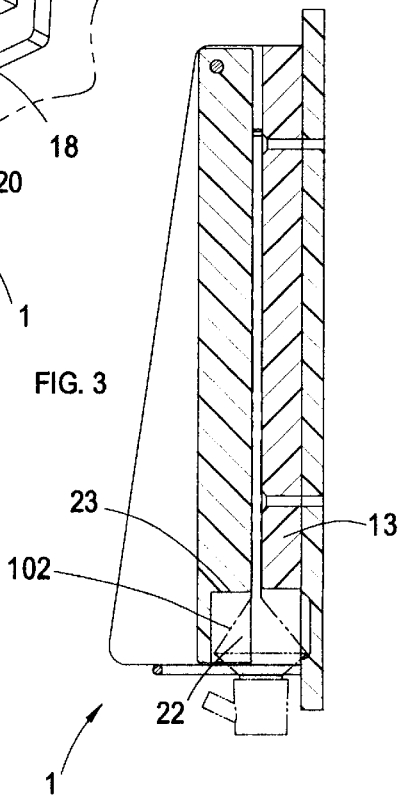
FIG. 3 is a cross sectional view of an emptied toothpaste tube in the toothpaste dispenser in accordance with the present invention.
Figure 4:
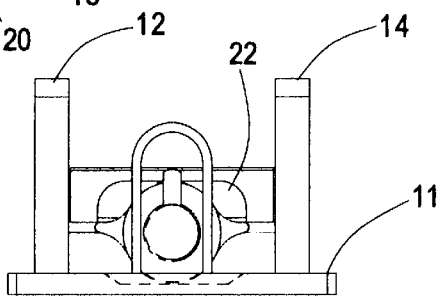
FIG. 4 is a front view of a toothpaste dispenser in accordance with the present invention.

With reference now to the drawings, and particularly to FIG. 1, there is shown a perspective view of a toothpaste dispenser 1. The toothpaste dispenser 1 includes a base 10, a first wall 12, a second wall 14, a squeeze flap 16, a tube retainer 18, and a dispenser nozzle 20. With reference to FIGS. 2–4, the base 10 includes a base plate 11 and a squeeze plate 13 which is fastened to the base plate 11. The first wall 12 and the second wall 14 are fastened to the base plate 11 such that a toothpaste tube 100 may be easily inserted therebetween. A second end of the squeeze flap 16 is pivotally mounted to second ends of the first wall 12 and the second wall 14 such that the squeeze flap 16 freely swings. A tube retainer 18 is mounted to the base plate 11 at a first end thereof. The tube retainer 18 retains the toothpaste tube 100 when pressure is exerted thereupon. The toothpaste dispenser 1 is preferably mounted downward as shown in FIGS. 2 and 4.

A notch 22 is formed in the first end of the squeeze flap 16. A first end of the squeeze plate 13 is positioned substantially flush to the bottom 23 of the notch 22 in FIG. 3. When the toothpaste tube 100 is fully squeezed; the notch 22 and the position of the squeeze plate 13 provide relief for the collar 102 of the tooth paste tube 100, such that the collar 102 is not damaged and the remaining toothpaste is extracted from the toothpaste tube 100. Damage to the collar 102 results in a break in the toothpaste tube 100 with toothpaste oozing out to make a mess.

Figure 5:
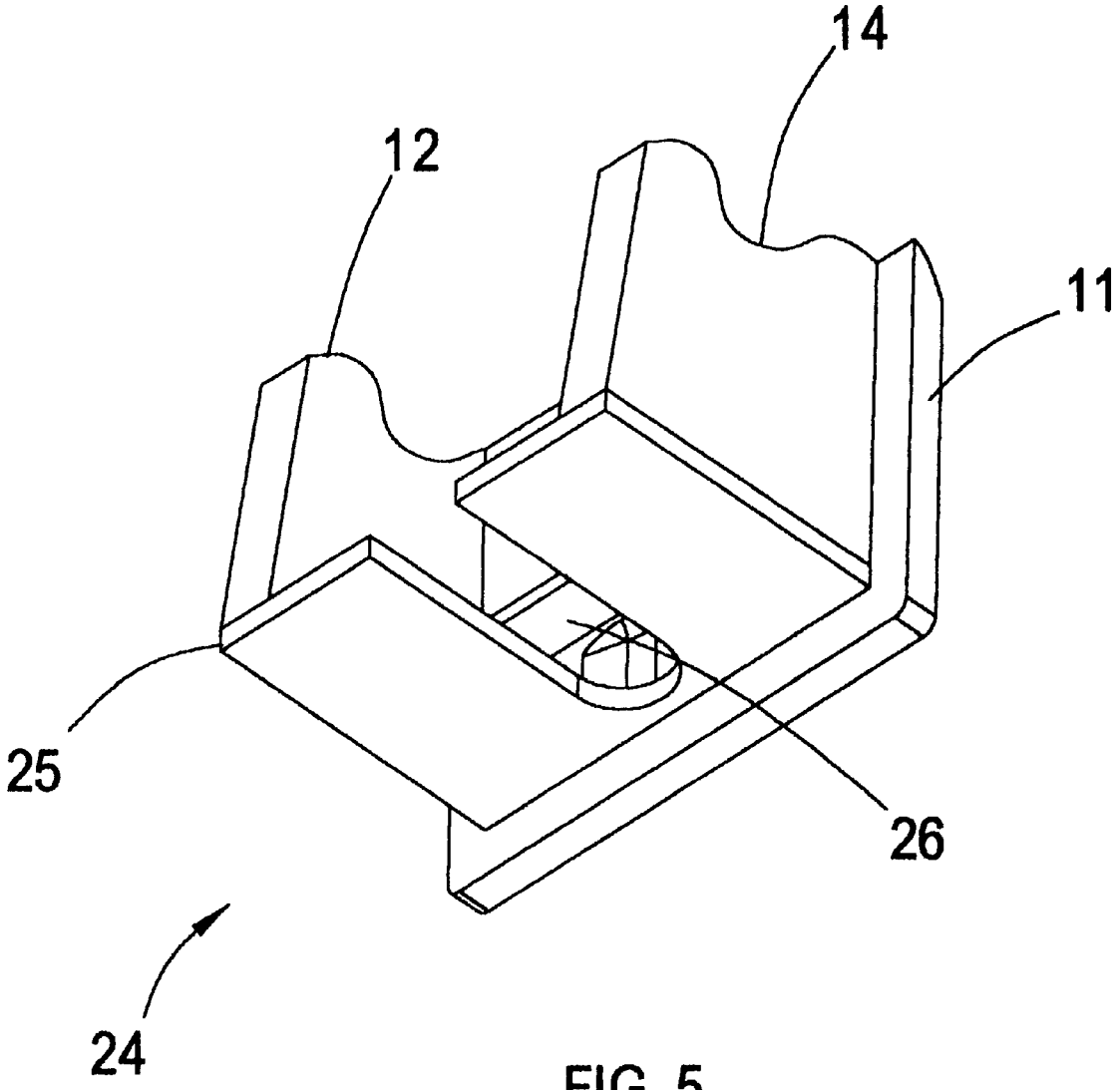
FIG. 5 is a perspective view of a second preferred embodiment of a tube retainer in accordance with the present invention.

FIG. 5 shows an easy loading tube retainer 24. The easy loading tube retainer 24 includes a plate 25 with a U-shaped slot 26 formed in the top thereof. Loading and unloading of the toothpaste tube 100 into the easy loading tube retainer 24 only requires that the squeeze flap 16 be swung about 30 degrees. Loading and unloading of the toothpaste tube 100 into the tube retainer 18 requires that the squeeze flap 16 be swung nearly 180 degrees; insertion of a first end of the toothpaste tube 100 into the tube retainer 18; and a second end of the toothpaste tube 100 then flexed over the squeeze flap 16.

Figure 6:
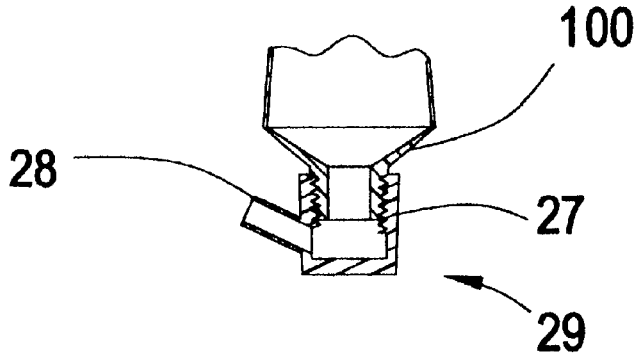
FIG. 6 is a cross sectional view of a side dispensing nozzle in accordance with the preferred invention.

There are two preferred embodiments of the dispenser nozzle 20. The first preferred embodiment of the dispenser nozzle 20 is a side dispensing nozzle 29. With reference to FIG. 6, the side dispensing nozzle 29 includes a small tube 28 which extends outward and slightly upward from a body 27. When the toothpaste tube 100 is squeezed, the tooth paste exits through the small tube 28 on to the tooth brush of an user. Since the small tube 28 is not sealed after usage it is preferably titled slightly upward to prevent tooth paste from running out. The side dispensing nozzle 29 is fastened to a toothpaste tube by screwing the threads of the inner diameter on to the nozzle of the toothpaste tube 100.

Figure 7:
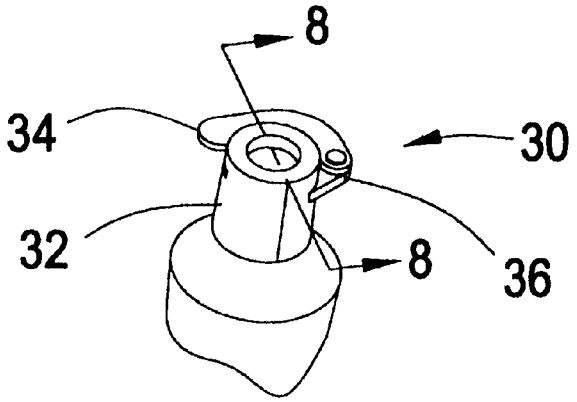
FIG. 7 is a perspective view of a swing nozzle in accordance with the present invention.
Figure 8:
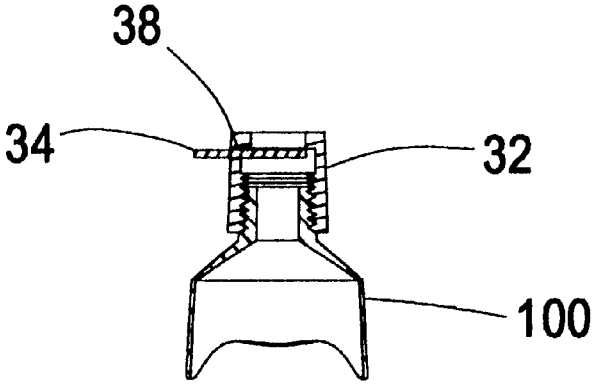
FIG. 8 is a cross sectional view of a swing nozzle in accordance with the present invention

FIGS. 7 and 8 show the second preferred embodiment of the dispenser nozzle which is a swing nozzle 30. The swing nozzle 30 includes a body 32 with a slot 38 which is formed in a wall thereof. A flange 36 extends outward from the body 32. A swing lever 34 is pivotally mounted to the flange 36 such that the swing lever may be rotated to open and close the swing nozzle 30. The swing nozzle 30 is fastened to a toothpaste tube 100 by screwing the threads of the inner diameter on to the nozzle of the toothpaste tube.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A toothpaste dispenser comprising:

a base;

a first wall attached to said base;

a second wall attached to said base, such that a toothpaste tube may be easily inserted between said first wall and said second wall;

a squeeze flap having a first end and a second end, said second end of said squeeze flap being pivotally connected to a second end of said first and second walls, a notch being formed in a first end of said squeeze flap;

a tube retainer being attached to said base at a first end of said first and second walls.

2. The toothpaste dispenser of claim 1, further comprising:

said base including a base plate and a squeeze plate, said squeeze plate being fastened to said base plate, a first end of said squeeze plate being positioned substantially flush to a bottom of said notch in said squeeze flap.

3. The toothpaste dispenser of claim 1, further comprising:

said tube retainer being a U-shaped device which is inserted into the first end of said base.

4. The toothpaste dispenser of claim 1, further comprising:

said tube retainer being an easy loading tube retainer, said easy loading tube retainer including a plate, said plate having a slot formed in a top thereof.

5. The toothpaste dispenser of claim 1, further comprising:

a side dispensing nozzle having a body and a small tube extending from an inside diameter of said body, said inner diameter of said body having threads structured to be threaded on to a nozzle of a toothpaste tube.

6. The toothpaste dispenser of claim 1, further comprising:

a swing nozzle having a body with a slot formed in a wall thereof, said body having a flange which extends outward from thereof; and a swing lever being pivotally mounted to said flange such that said swing lever may be rotated to open and close said swing nozzle, said inner diameter of said body having threads structured to be threaded on to the nozzle of a toothpaste tube.

7. A toothpaste dispenser comprising:

a base having a base plate and a squeeze plate fastened to said base plate;

a first wall attached to said base;

a second wall attached to said base, such that a toothpaste tube may be easily inserted between said first wall and said second wall;

a squeeze flap having a first end and a second end, said second end of said squeeze flap being pivotally connected to a second end of said first and second walls, a notch being formed in a first end of said squeeze flap, a first end of said squeeze plate being positioned substantially flush to a bottom of said notch in said squeeze flap; and a tube retainer being attached to said base at the first end of said first and second walls, wherein a toothpaste tube being retained thereby.

8. The toothpaste dispenser of claim 7, further comprising:

said tube retainer being a U-shaped device which is inserted into a first end of said base plate.

9. The toothpaste dispenser of claim 7, further comprising:

said tube retainer being an easy loading tube retainer, said easy loading tube retainer including a plate, said plate having a slot formed in a top thereof.

10. The toothpaste dispenser of claim 8, further comprising:

a side dispensing nozzle having a body and a small tube extending from an inside diameter of said body, said inner diameter of said body having threads structured to be threaded on to the nozzle of a toothpaste tube.

11. The toothpaste dispenser of claim 7, further comprising:

a swing nozzle having a body with a slot formed in a wall thereof, said body having a flange which extends outward from thereof; and a swing lever being pivotally mounted to said flange such that said swing lever may be rotated to open and close said swing nozzle, said inner diameter of said body having threads structured to be threaded on to a nozzle of a toothpaste tube.

12. A toothpaste dispenser which structured to receive a toothpaste tube comprising:

a base having a base plate and a squeeze plate fastened to said base plate;

a first wall attached to said base;

a second wall attached to said base, such that the toothpaste tube may be easily inserted between said first wall and said second wall;

a squeeze flap having a first end and a second end, said second end of said squeeze flap being pivotally connected to a second end of said first and second walls, a notch being formed in a first end of said squeeze flap, a first end of said squeeze plate being positioned substantially flush to a bottom of said notch in said squeeze flap;

a tube retainer being attached to said base at the first end of said first and second walls, wherein a toothpaste tube being retained thereby; and a dispenser nozzle which is screwed on to a nozzle of the toothpaste tube, wherein when pressure is applied to said squeeze flap, toothpaste flows out of said dispenser nozzle.

13. The toothpaste dispenser which structured to receive a toothpaste tube of claim 12, further comprising:

said tube retainer being a U-shaped device which is inserted into a first end of said base.

14. The toothpaste dispenser which structured to receive a toothpaste tube of claim 12, further comprising:

said tube retainer being an easy loading tube retainer, said easy loading tube retainer including a plate, said plate having a slot formed in a top thereof.

15. The toothpaste dispenser which structured to receive a toothpaste tube of claim 12, further comprising:

said dispenser nozzle being a side dispensing nozzle, said side dispensing nozzle having a body and a small tube extending from an inside diameter of said body, said inner diameter of said body having threads structured to be threaded on to the nozzle of a toothpaste tube.

16. The toothpaste dispenser which structured to receive a toothpaste tube of claim 12, further comprising, said dispenser nozzle being a side swing nozzle, said swing nozzle having a body with a slot formed in a wall thereof, said body having a flange which extends outward from thereof; and a swing lever being pivotally mounted to said flange such that said swing lever may be rotated to open and close said swing nozzle, said inner diameter of said body having threads structured to be threaded on to a nozzle of a toothpaste tube.

* * * * *